US005487587A

United States Patent [19]

Hylton

[11] Patent Number: 5,487,587

[45] Date of Patent: Jan. 30, 1996

[54] SEAT CUSHION ASSEMBLY REMOVABLY RETAINABLE ON A SEAT SURFACE

[75] Inventor: Frances G. Hylton, Ruther Glen, Va.

[73] Assignee: Decorite, Inc., Ashland, Va.

[21] Appl. No.: 358,683

[22] Filed: Dec. 19, 1994

Related U.S. Application Data

[63] Continuation of Ser. No. 293,192, Aug. 19, 1994, abandoned, which is a continuation of Ser. No. 972,106, Nov. 5, 1992, abandoned, which is a continuation of Ser. No. 704,987, May 24, 1991, abandoned.

[51] Int. Cl.[6] ..... A47C 27/00

[52] U.S. Cl. ..... 297/219.1; 297/461

[58] Field of Search ..... 297/218, 219.1, 297/224, 229, 461, 457.21, 452.26

[56] References Cited

U.S. PATENT DOCUMENTS

| | | | |
|---|---|---|---|
| 942,793 | 12/1909 | Reineke . | |
| 1,551,452 | 8/1925 | Arias . | |
| 1,991,751 | 2/1935 | Kennedy | 297/219 X |
| 2,191,956 | 2/1940 | Coldren | 297/224 |
| 2,229,160 | 1/1941 | Wittcoff | 297/219 X |
| 2,483,223 | 9/1949 | Moss | 297/219 |
| 3,335,435 | 8/1967 | Marsh et al. . | |
| 3,338,630 | 8/1967 | Dudley | 297/219 |
| 4,319,781 | 3/1982 | Tsuge | 297/219 X |
| 4,563,785 | 1/1986 | Samelson . | |
| 4,740,034 | 4/1988 | Snyder et al. . | |
| 4,761,035 | 8/1988 | Urai . | |

FOREIGN PATENT DOCUMENTS

| | | | |
|---|---|---|---|
| 1429376 | 2/1969 | Germany | 297/219 |

*Primary Examiner*—Jose V. Chen

*Attorney, Agent, or Firm*—Millen, White Zelano & Branigan

[57] ABSTRACT

A seat cushion assembly comprises a cushion for placement on a top surface of a seat and a skirt extending downwardly from the cushion over an edge of the top surface of the seat. The seat cushion assembly can be removably retained over edges of the top surface of a seat, such as a stool. In a preferred embodiment, the lower portion of the skirt includes an elastic section for securing the assembly over the top surface of the seat.

14 Claims, 2 Drawing Sheets

SEAT CUSHION ASSEMBLY REMOVABLY RETAINABLE ON A SEAT SURFACE

This application is a continuation of application Ser. No. 08/293,192 filed Aug. 19, 1994 now abandoned which, in turn, is a continuation of Ser. No. 07/972,106 filed Nov. 5, 1992 now abandoned which in turn is a continuation of Ser. No. 07/704,987 filed May 24, 1991 now abandoned.

BACKGROUND OF THE INVENTION

The present invention relates to a seat cushion assembly for placement on the upper surface of a seat, such as a stool. The assembly includes a cushion and a skirt extending downwardly from the cushion, such that the skirt extends over the edge of the seat when the cushion is placed on this upper surface of the seat.

The cushion assembly includes means for removably retaining the cushion on the seat surface. Thus, once the cushion assembly is placed on the seat surface, slippage of the cushion on the seat surface is minimized. Additionally, since the cushion assembly is removable, it can be easily removed for cleaning purposes.

DESCRIPTION OF THE PREFERRED EMBODIMENTS

Figure 1:
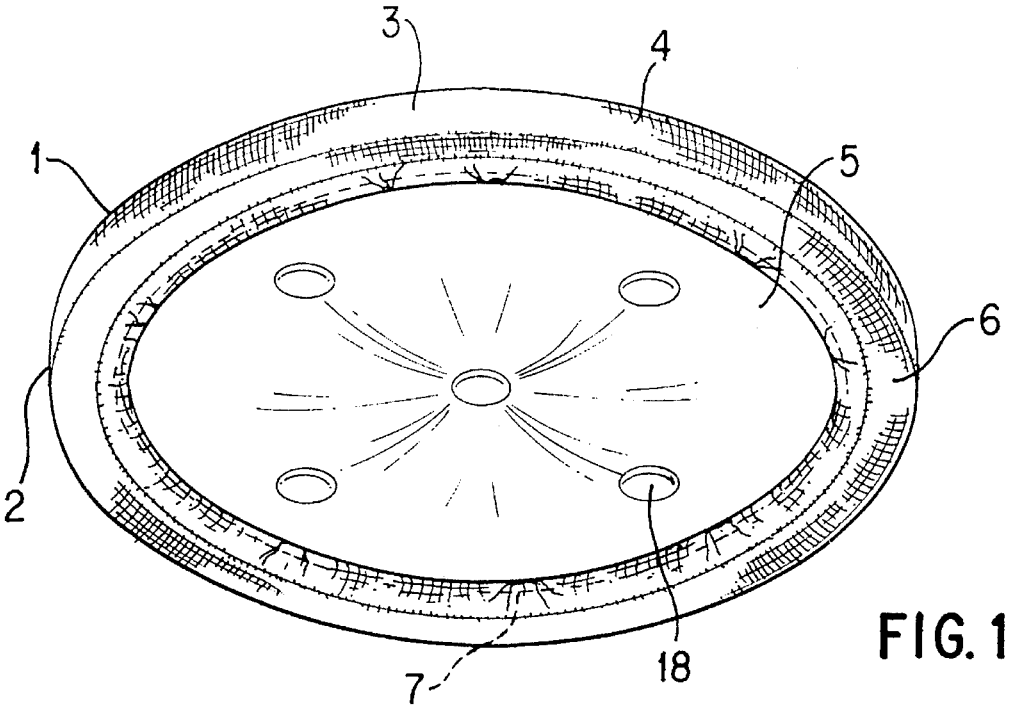
FIG. 1 is a bottom perspective view of a seat cushion assembly according to a preferred embodiment.
Figure 2:
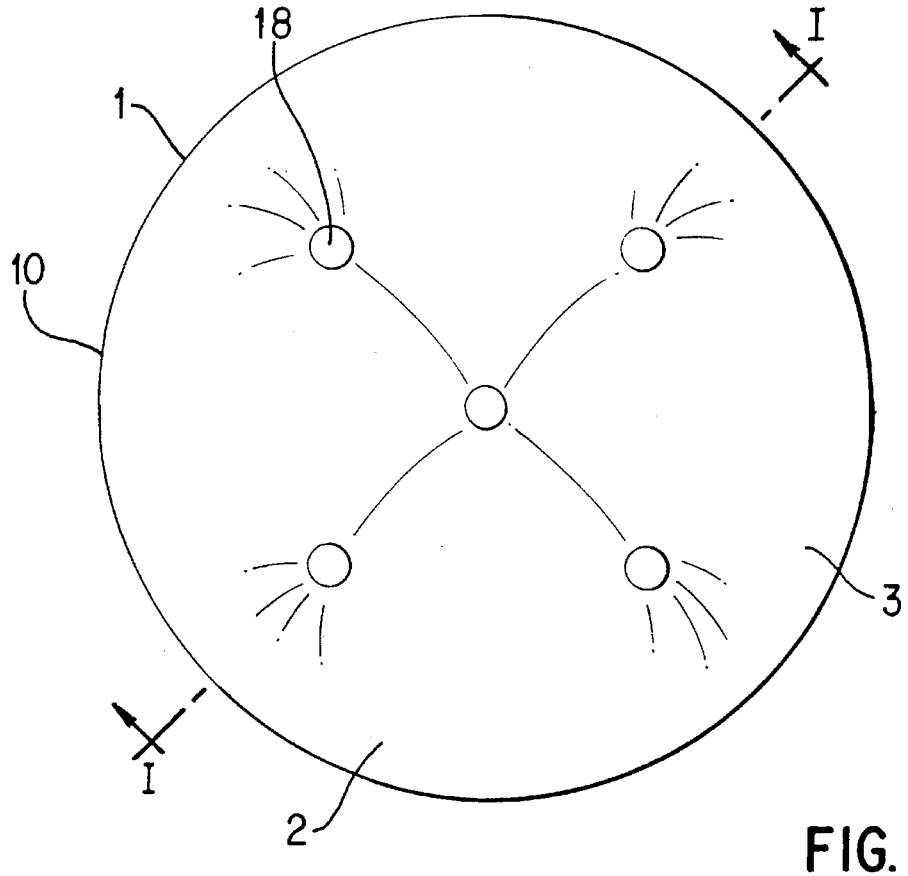
FIG. 2 is a top view thereof.
Figure 3:
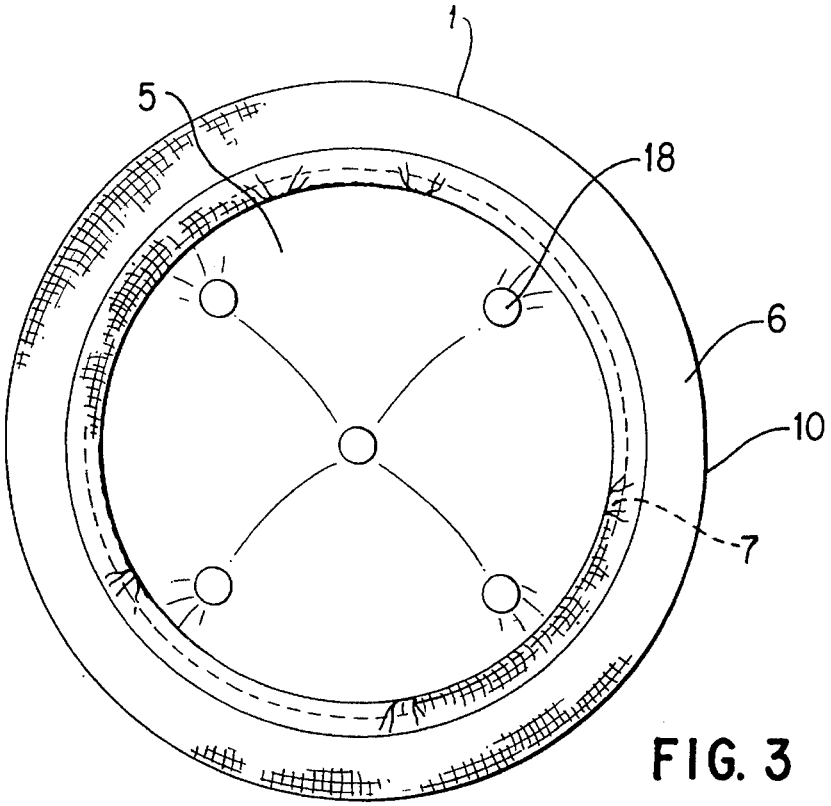
FIG. 3 is a bottom view thereof.
Figure 4:
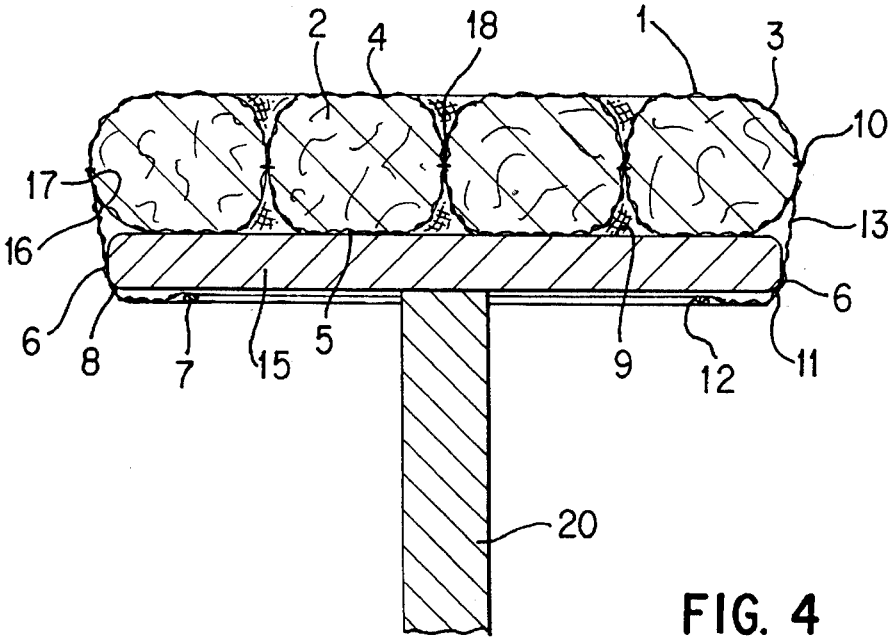
FIG. 4 is a cross-sectional view thereof taken along lines I—I of FIG. 2, the cushion assembly being placed on the surface of a seat of a stool.

FIGS. 1 to 4 schematically illustrate a seat cushion assembly according to a preferred embodiment of the present invention. The seat cushion assembly comprises a cushion 1, including an inner cushioning member 2 and an outer cover 3 which surrounds at least an upper surface of inner cushioning member 2. In a preferred embodiment, outer cover 3 includes both an upper cover 4 for covering an upper surface of the inner cushioning member and a lower cover 5 for covering a lower surface of the inner cushioning member, such that the outer cover completely surrounds the entire inner cushioning member as shown in FIGS. 1, 3 and 4. If provided as separate pieces of material, the upper and lower covers 4, 5 can be sewn together along a perimeter 10 of the cushion.

Skirt 6 extends downwardly from cushion 1. An upper portion 13 of skirt 6 is connected to outer cover 3, such as with stitching, near outer perimeter 10 of the cushion. For example, the skirt may have a width of about 2.5 to 5 inches. In a preferred embodiment, skirt 6 extends around the entire perimeter of the cushion. When outer cover 3 includes both upper and lower covers 4, 5, the edges of each of upper and lower covers 4, 5 and skirt 6 can be joined with the same stitching at perimeter 10.

As shown in FIG. 4, lower portion 11 of skirt 6 extends over and around vertically extending, uninterrupted edge portion 8 uniting with the upper surface 9 of the seat 15 of stool 20. As is illustrated in the cross-sectional view of FIG. 4, the skirt 6 is joined to the cover 3 by stitches forming an internally beadless seam 16 at an inner area 17 of the seam facing the round seat 15 of the stool.

It is preferred that each of the outer cover, the skirt, and the inner cushioning member is made of a washable material. A suitable material for the outer cover is cotton or a polyester/cotton blend. The skirt can be made of the same material as the outer cover, and if the outer cover includes a design pattern, the skirt can be provided with the same or a matching design for aesthetic purposes. Preferably, the inner cushioning member is not only washable, but also made of a resiliently deformable material, such as cut polyester fibers, to provide comfort to a user of the cushion. Of course, when the inner cushioning member is made of cut polyester fibers, the outer cover should entirely surround the inner cushioning member to prevent loss of the cut fibers.

The cushion assembly includes retaining means for removably retaining the cushion assembly on the upper surface of a seat. For example, a section 7 of lower portion 11 of skirt 6 can be elastic. Preferably, section 7 is provided at bottom edge 12 of skirt 6, as shown in the drawing figures. In a preferred embodiment, elastic section 7 is in the form of an elastic band provided along bottom edge 12 of skirt 6. For this embodiment, the bottom edge of the skirt can be overlapped with the elastic band provided in this overlapping portion. A suitable material for the elastic band is a calendered elastic band having a width of 0.375 inches.

In order to securely retain the cushion assembly to the seat, it is preferred that perimeter 10 of the cushion is substantially congruous with the perimeter of the seat surface, and that skirt 6 is provided along the entire perimeter of the cushion and elastic section 7 is provided along the entire bottom edge 12 of skirt 6. The cushion assembly is particularly useful for a round seat surface having a diameter of 12 to 14 inches.

As shown in the drawing figures, cushion 1 can be provided with tufts 18. The tufts can be formed with stitches joining upper and lower covers 4, 5 at the location of a tuft, whereby inner cushioning member 2 is provided in the interspace between the upper and lower covers and around the tufts.

Although the drawing figures illustrate a round cushion assembly placed on a round seat surface, alternate shapes are within the scope of the invention. For example, the cushion assembly may be rectangular with a skirt extending from the perimeter of the cushion over the edges of a rectangular seat. And although the seat illustrated in FIG. 4 is a stool with a single pedestal, cushion assemblies for other seats are within the scope of the invention. For example, the seat can be a multi-legged stool.

Although a detailed description has been provided above, the present invention is not limited thereto, but rather is defined by the following claims.

What is claimed is:

1. A seat cushion assembly specifically configured for a stool, said stool having a seat with a generally planar, upper support surface and a generally planar, lower surface extending generally parallel with respect to the upper support surface, the lower support surface always being lower than the upper support surface and being joined thereto by a generally vertically extending edge portion, said assembly comprising:

a cushion for placement on said upper support surface of said seat, said cushion comprising an inner cushioning member of cushioning material having an outer perimeter and an outer cover of a single piece of material surrounding at least an upper surface of said inner cushioning member to provide a single compartment for the material and being connected thereto at said outer perimeter to form an internally beadless seam with said cushioning material being contained in said single compartment, said inner cushioning member and said outer cushioning cover being dimensioned such that said cushion covers substantially the entire upper support surface when the seat cushion is installed on said seat;

a skirt extending from said cushion, the skirt comprising an upper portion connected to said seat cushion at said beadless seam and extending generally vertically over the generally vertically extending edge of the seat; said skirt having a lower portion extending from the upper portion and extending radially inwardly over a substantial portion of the lower surface of said seat for non-positive engagement therewith when said seat cushion is mounted on said seat; and, an elastic member disposed at said lower portion of said skirt to gather the lower portion of the skirt and hold the skirt in abutment with said generally planar lower surface of said seat.

2. The cushion of claim 1 wherein the upper surface of the cushion is convex when the seat cushion is installed on the seat.

3. The cushion of claim 1 wherein said stool is round and said outer perimeter is circular.

4. The cushion of claim 3 wherein said stool is a bar stool.

5. A stool and seat cushion assembly combination comprising a seat having a generally planar upper support surface and a generally planar lower support surface generally parallel to the upper support surface, the lower support surface always being lower than the upper support surface and joined thereto by a generally vertically extending edge portion:

a cushion for placement on said upper support surface of the seat, said cushion comprising an inner cushioning member of cushioning material having an outer perimeter and an outer cover of a single piece of material surrounding at least an upper surface of said inner cushioning member to provide a single compartment for the cushioning material and being connected thereto at said outer perimeter to form an internally beadless seam with all of the cushioning material being contained in the single compartment, said inner cushioning member and said outer cushioning cover being dimensioned such that said cushion covers substantially the entire upper support surface when the seat cushion is installed on said seat;

a skirt extending from said cushion, the skirt comprising an upper portion connected to said seat cushion at said beadless seam and extending generally vertically over the generally vertically extending edge of the seat; said skirt having a lower portion extending from the upper portion and extending radially inwardly over a substantial portion of the lower surface of the seat for non-positive engagement therewith when the seat cushion is mounted on the seat; and an elastic member disposed at said lower portion of said skirt to gather the lower portion of the skirt and hold the skirt in abutment with the substantially planar lower surface of the seat.

6. The cushion of claim 5 wherein said stool is round and said outer perimeter is circular.

7. The cushion of claim 6 wherein said stool is a bar stool.

8. The stool and seat cushion assembly of claim 5 wherein the upper surface of the cushion is convex when the seat cushion is installed on the seat.

9. A stool and seat cushion assembly combination comprising:

a seat forming a part of said bar stool, said seat having a generally planar upper support surface and a generally planar lower support surface extending generally parallel to the upper support surface, said lower support surface always being lower than said upper support surface and being joined thereto by a generally vertically extending uninterrupted edge portion:

a cushion for detachable placement on the upper support surface of said seat of said stool, said cushion comprising an inner cushioning member having an outer perimeter and an outer cover surrounding at least an upper surface of said inner cushioning member and being connected thereto along a seam, the seam being beadless at an inner area facing the seat, said inner cushioning member and said outer cushioning cover being dimensioned such that said cushion covers substantially the entire upper support surface when the seat cushion is installed on the seat and which said upper surface and said outer cover are convex when said seat cushion is installed on said seat;

a skirt extending from said cushion, the skirt having a lower portion; and, an elastic member disposed at said lower portion of said skirt to gather the lower portion of the skirt and hold the skirt extended over the edge of the seat and in abutment with said generally planar lower surface of the seat.

10. The combination of claim 9 wherein said outer cover is formed from a single piece of material surrounding at least an upper surface of said inner cushioning member to provide a single compartment for said inner cushioning member.

11. The cushion of claim 9 wherein said stool is round and said outer perimeter is circular.

12. The cushion of claim 11 wherein said stool is a bar stool.

13. The cushion of claim 12 wherein said outer cover is formed from a single piece of material surrounding at least an upper surface of said inner cushioning member to provide a single compartment for said inner cushioning member.

14. The cushion of claim 12 wherein said skirt includes an upper portion connected to said seat cushion at said beadless seam and extending generally vertically over said generally vertically extending uninterrupted edge portion; and, wherein said lower portion extends radially inwardly over a substantial portion of said lower surface of said seat.

* * * * *

UNITED STATES PATENT AND TRADEMARK OFFICE

CERTIFICATE OF CORRECTION

PATENT NO. : 5,487,587

DATED : January 30, 1996

INVENTOR(S) : Frances Gay HYLTON

It is certified that error appears in the above-indentified patent and that said Letters Patent is hereby corrected as shown below:

Column 2, line 57 reads "surface, the lower support surface always being lower than" should be amended to read -- surface, the lower surface always being lower than --.

CLAIM 1; Column 2, line 63 reads "member of cushioning material having an outer perim-" should be amended to read -- member of cushioning material and having an outer perim- --.

CLAIM 1; Column 2, line 67 reads "for the material and being connected thereto at said" should be amended to read -- for the material and being connected at said --.

Column 3, line 36 reads "member of cushioning material having an outer perim-" should be amended to read -- member of cushioning material and having an outer perim- --.

UNITED STATES PATENT AND TRADEMARK OFFICE

CERTIFICATE OF CORRECTION

PATENT NO. : 5,487,587

DATED : January 30, 1996

INVENTOR(S) : Frances Gay HYLTON

It is certified that error appears in the above-indentified patent and that said Letters Patent is hereby corrected as shown below:

Column 3, line 41 reads "for the cushioning material and being connected thereto" should be amended to read -- for the cushioning material and being connected --.

Column 4, line 22 reads "prising an inner cushioning member having an outer" should be amended to read -- prising an inner cushioning member and having an outer --.

Column 4, line 24 reads "being connected thereto along a seam, the seam being" should be amended to read -- being connected along a seam, the seam being --..

Signed and Sealed this

Eighth Day of October, 1996

*Attest:*

Bruce Lehman

BRUCE LEHMAN

*Attesting Officer*

*Commissioner of Patents and Trademarks*